US011596234B1

(12) United States Patent
Dawson et al.

(10) Patent No.: US 11,596,234 B1
(45) Date of Patent: Mar. 7, 2023

(54) PORTABLE SUPPORTIVE SEATING SYSTEM AND METHOD OF USE

(71) Applicants: Dony Dawson, Keller, TX (US); Stephen Hilton Savoie, Arlington, TX (US)

(72) Inventors: Dony Dawson, Keller, TX (US); Stephen Hilton Savoie, Arlington, TX (US)

( * ) Notice: Subject to any disclaimer, the term of this patent is extended or adjusted under 35 U.S.C. 154(b) by 0 days.

(21) Appl. No.: 17/469,593

(22) Filed: Sep. 8, 2021

Related U.S. Application Data

(60) Provisional application No. 63/237,823, filed on Aug. 27, 2021.

(51) Int. Cl.
*A47C 4/02* (2006.01)

(52) U.S. Cl.
CPC ..... *A47C 4/02* (2013.01); *A47C 4/021* (2013.01)

(58) Field of Classification Search
CPC ..... A47C 4/02; A47C 4/021; A47C 4/025; A47C 7/16; A47C 9/10; A47C 9/04; A47C 16/005; A47C 15/00
See application file for complete search history.

(56) References Cited

U.S. PATENT DOCUMENTS

| | | | | | |
|---|---|---|---|---|---|
| 3,752,532 | A * | 8/1973 | Yarus | A47C 4/021 | 297/440.19 |
| 3,847,435 | A * | 11/1974 | Skinner | A47C 4/027 | D6/374 |
| 4,846,530 | A * | 7/1989 | Noble | A47C 4/021 | 297/440.19 |
| 5,588,709 | A * | 12/1996 | Lewallen, Sr. | A47C 4/03 | 297/447.1 |
| D457,740 | S * | 5/2002 | Rosa | D6/368 | |
| D803,595 | S * | 11/2017 | Holland | D6/368 | |
| 2014/0165289 | A1* | 6/2014 | Trocchia | A47D 13/102 | 297/451.8 |
| 2014/0265465 | A1* | 9/2014 | Johansson | A47C 7/62 | 297/452.11 |

FOREIGN PATENT DOCUMENTS

| | | | | |
|---|---|---|---|---|
| AT | 3411 | U1 * | 3/2000 | |
| BR | 202017019528 | U2 * | 6/2018 | |
| CA | 3002219 | A1 * | 10/2019 | |
| CN | 107772868 | A * | 3/2018 | |
| DE | 4100606 | A1 * | 7/1992 | |
| DE | 202005006926 | U1 * | 9/2005 | A47C 4/021 |
| DE | 202005015481 | U1 * | 6/2006 | A47C 3/28 |
| DE | 202006005560 | U1 * | 7/2006 | A47C 3/04 |
| DE | 202011104735 | U1 * | 1/2013 | A47B 85/04 |
| FR | 3005838 | A1 * | 11/2014 | |
| JP | 2010264102 | A * | 11/2010 | A47C 4/021 |

* cited by examiner

*Primary Examiner* — Timothy J Brindley
(74) *Attorney, Agent, or Firm* — Leavitt Eldredge Law Firm

(57) ABSTRACT

A portable supportive seating system allows for a person to move a chair with them and then assemble it in remote locations and there receive support for their back and general posture support from it. A back support has an attachment that allows a rest or seat to be placed through it and holds the person that sits on it. A guard is attached to the bottom edge of the back support to protect it.

3 Claims, 12 Drawing Sheets

PORTABLE SUPPORTIVE SEATING SYSTEM AND METHOD OF USE

BACKGROUND

1. Field of the Invention

The present invention relates generally to seating systems and methods, and more specifically, to a portable supportive seating system that provides a rigid back brace to allow the person sitting therein to rest with proper posture. The system disassembles and reassembles so that it is portable and storable.

2. Description of Related Art

Seating systems are well known in the art and are effective means that provide a seat whereon a person rests their body usually in a seated position. Common seating systems include chairs, stools couches, and the like. Common seats are found in many forms and for a myriad of specific uses. Some chairs are portable, and these include folding chairs that are hinged but retain their shape in at least one dimension. Collapsible chairs commonly retract in multiple dimensions and have a seat and back support made of fabric.

One of the problems associated with common seating systems is their limited efficiency. For example, collapsible chairs made of fabric do not provide support to the back or encourage a posture that places the spine and back in a healthy position. Portable chairs that offer more supportive surfaces to sit and rest the back on are not portable enough to be carried for any large distance because of their size and weight. This results in poor posture for a lighter smaller load.

Proper posture is always recommended and even more so for those that exercise or spend large amounts of time in a seated position. The lack of a portable, light, and supportive seat is a hindrance to those that need them.

Accordingly, although great strides have been made in the area of seating systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
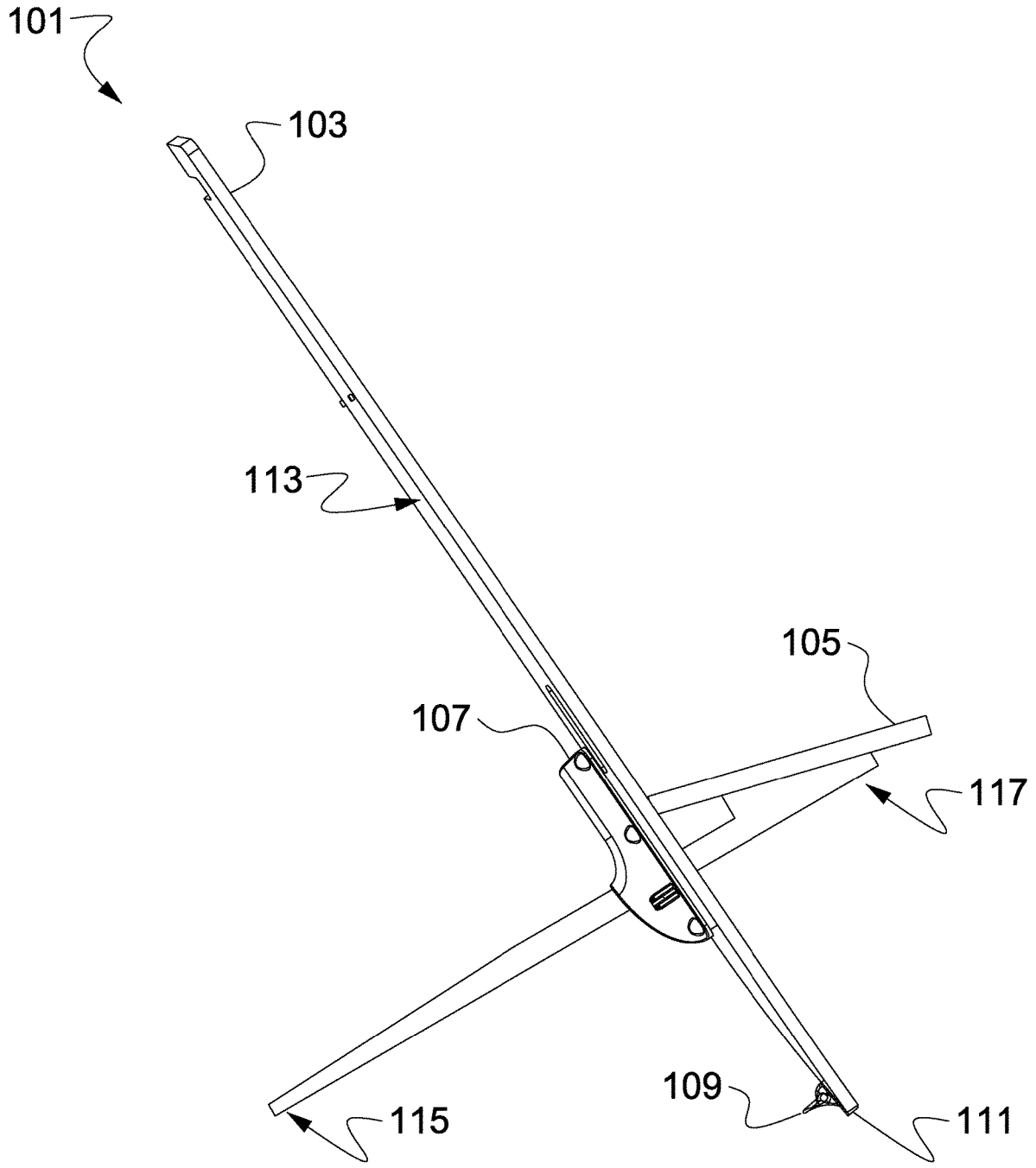
FIG. 1 is a side view of a portable supportive seating system in accordance with a preferred embodiment of the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional seating systems. Specifically, the present invention provides for a light and compact seat that enables correct posture through a back support. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIG. 1 depicts a side view of a portable supportive seating system in accordance with a preferred embodiment of the present application. It will be appreciated that system 101 overcomes one or more of the above-listed problems commonly associated with conventional seating systems.

In the contemplated embodiment, system 101 includes a back support 103 with a rest 105 passing therethrough via an attachment 107. The attachment 107 is joined to the back support via a rear surface 113 and fasteners, adhesive, or the like. A guard 109 is likewise attached to the back support 103 at a bottom end 111. The rest 105 has a far end 115 that is opposite the rest end 117.

Figure 2:
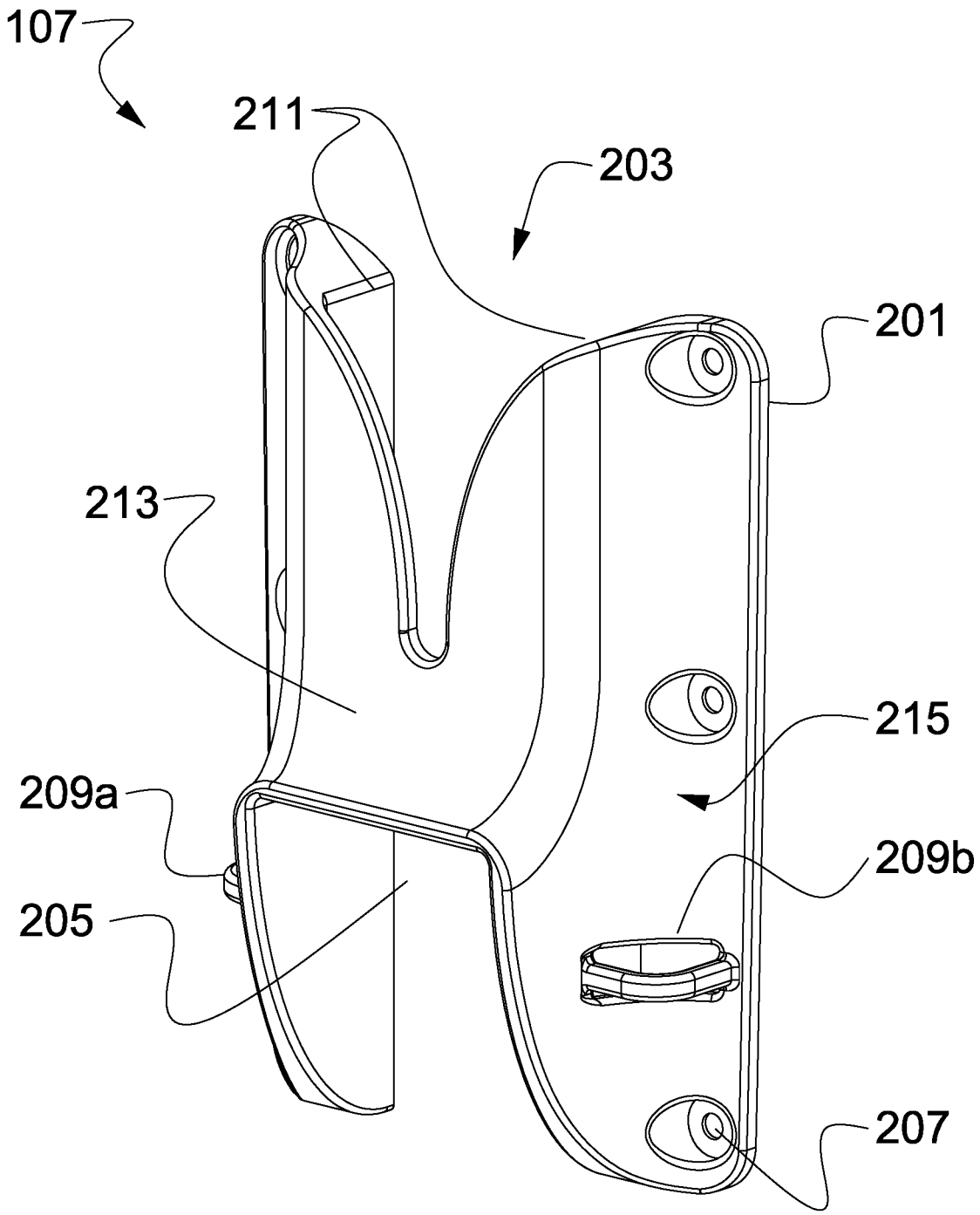
FIG. 2 is a rear perspective view of the attachment of FIG. 1.

Referring to FIG. 2 the attachment 107 is further depicted and includes a body 201 with legs 211 that extend therefrom on either edge of a bridge 213. A channel 203 is formed therebetween. Each leg 211 includes fastener locations 207 that pass through the legs 211 and enable attachment 107 to join with the back support 103. The body 201 further includes an opening 205 in the bridge 213 that passes therethrough and intersects with the channel 203. The opening 205 allows the rest 105 to enter and pass through the attachment 107. The body 201 also has flanges 209 that extend out and away from the outside surfaces 215 of the legs 211. The flanges 209 could be solid or have holes therein.

Figure 3:
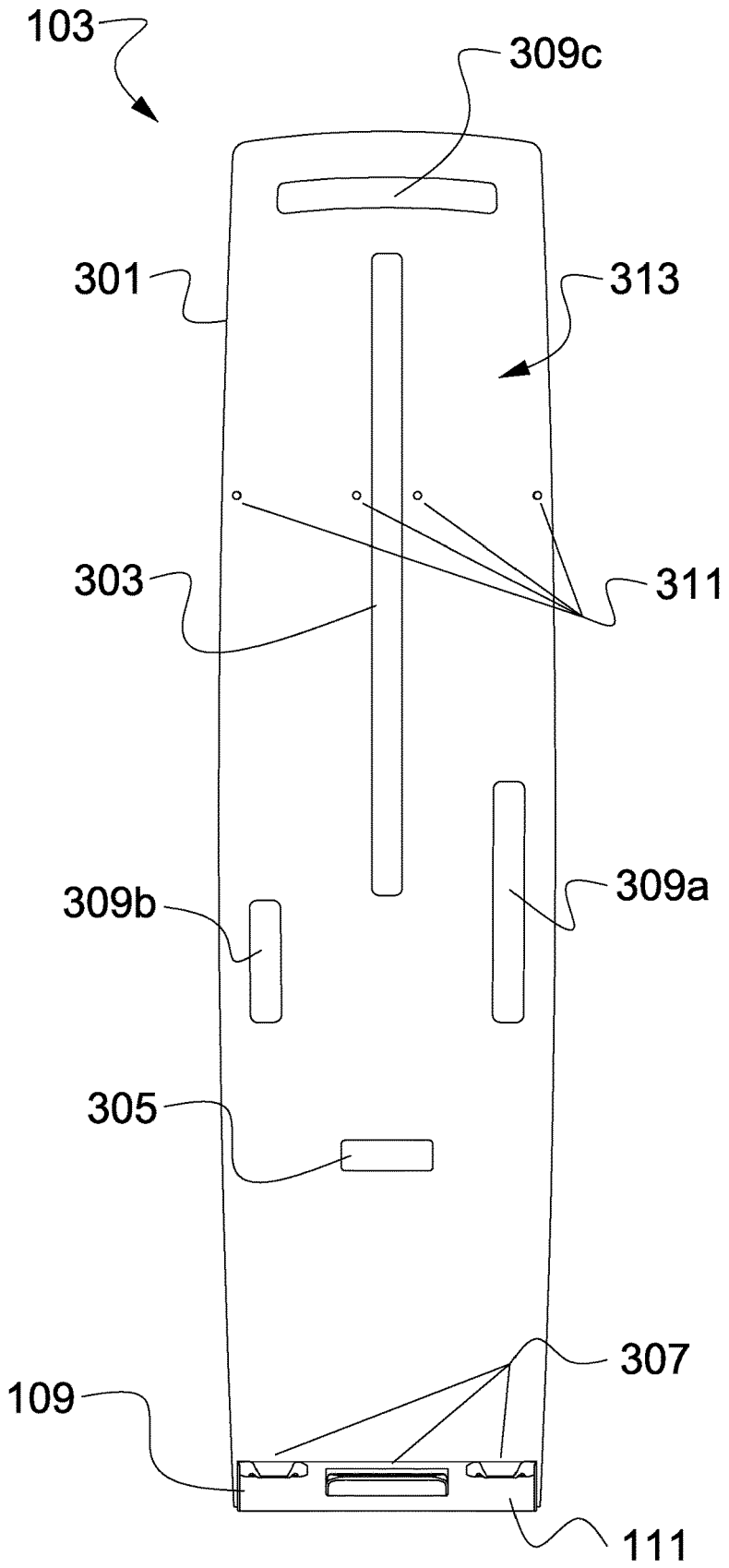
FIG. 3 is a rear view of the back support of FIG. 1.
Figure 4A:
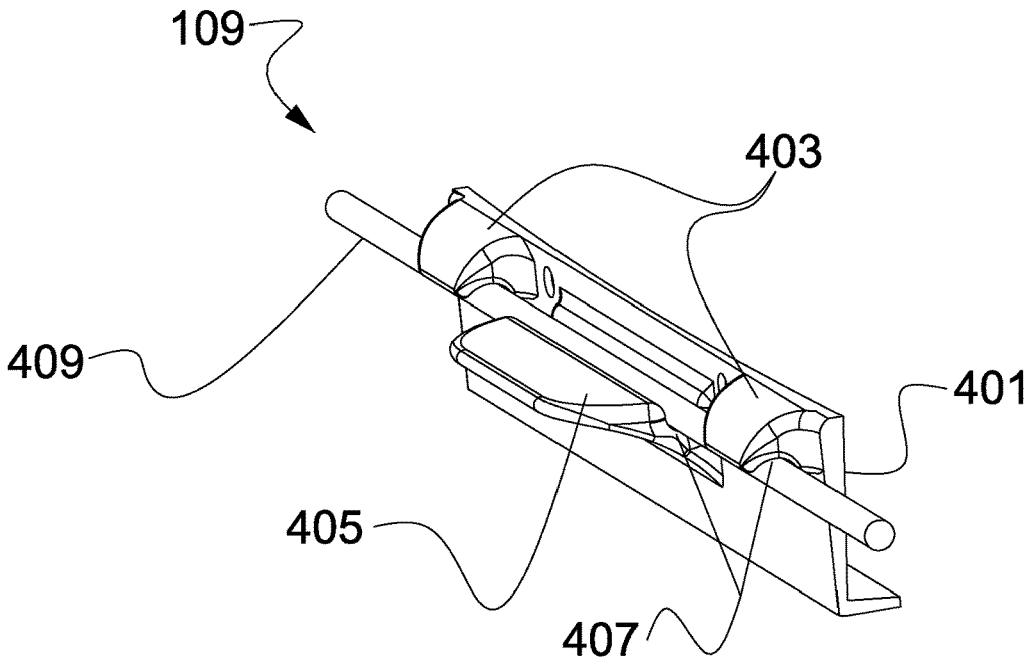
FIGS. 4A and 4B are perspective views of the guard of FIG. 1.
Figure 4B:
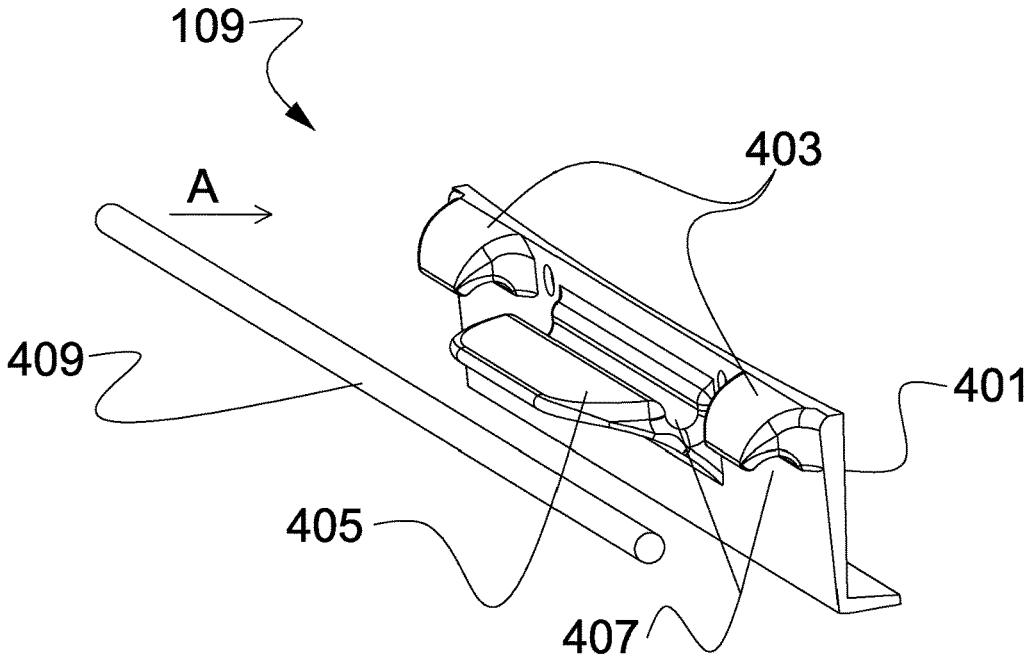

The back support 103 is further depicted by FIG. 3 and includes a support body 301 that is generally planer and includes a slot 303 that passes therethrough and accommodates a head support or another accessory. A hole 305 also passes through the body 301 and aligns with the opening 205 of the attachment 107 when it is joined to the back support 103. The guard 109 is attached at the bottom of the body 301 and includes arms 307 that are configured to protect the bottom end 111 of the support body 301 and also to hold a shaft therebetween.

It is contemplated that the body 301 includes additional holes 309 that could function as handles, joints, or the like and that the shape and size thereof could vary to accommodate the use thereof. Additionally, fasteners 311 are attached to the back surface 313 of the body 301 and allow for accessories to attach thereto. For example, straps that allow the back support 103 to be carried are attached to the fasteners 311 and are removable therefrom.

Referring to FIGS. 4A, 4B, 5, and 6 the guard 109 is further depicted and includes a guard body 401 to which the arms 307 are attached and extend therefrom. In the current embodiment, an upper arm 403 is positioned above a lower arm 405. The upper arm 403 and lower arm 405 have channels 407 therein that allow a cylindrical body, such as a shaft 409, to be placed therebetween as depicted by motion A and rotate therein.

Figure 5:
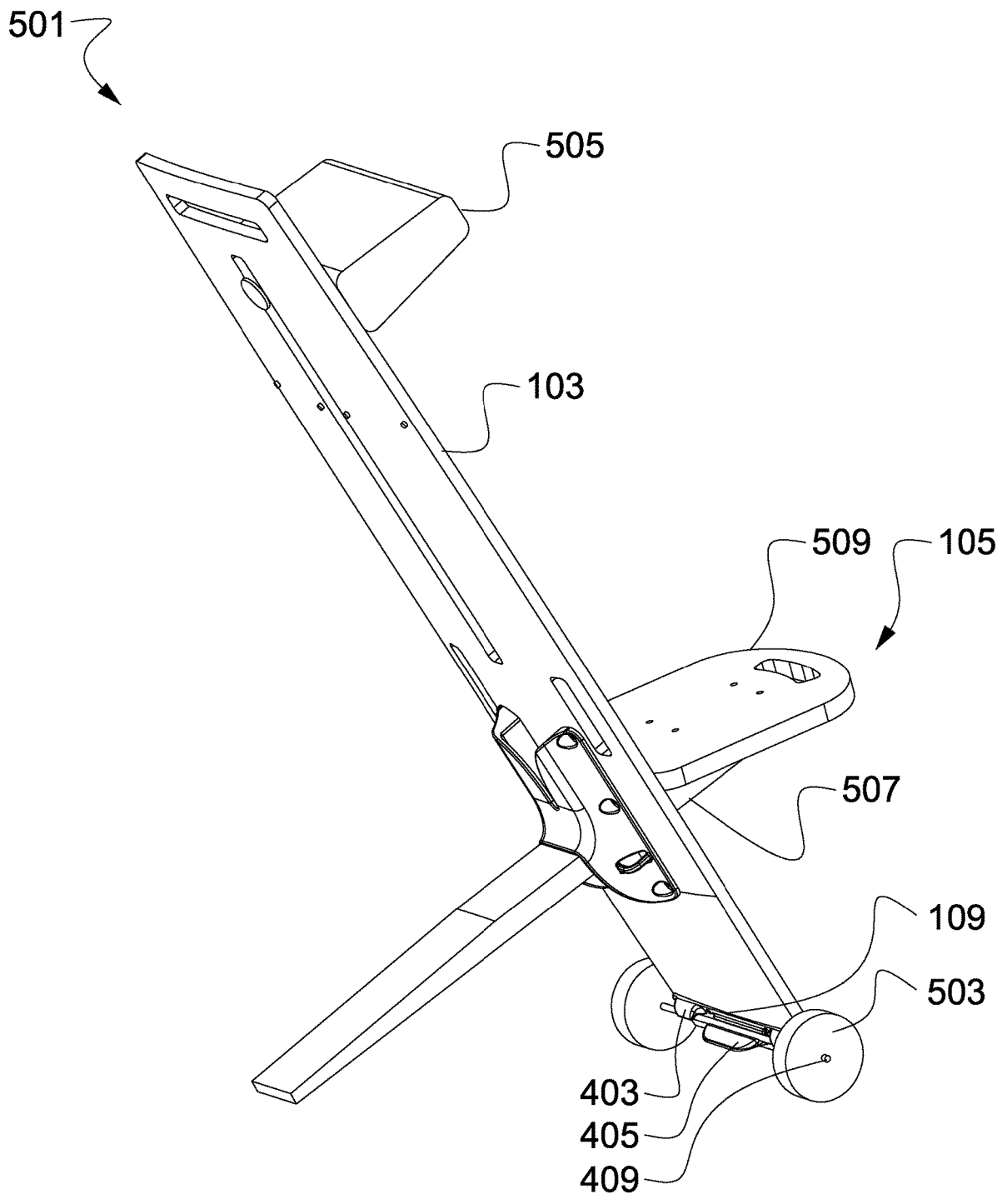
FIG. 5 is a rear perspective view of an alternate embodiment of the system of FIG. 1.

It is contemplated that the shaft 409 could have wheels 503 attached at either end as depicted by FIG. 5. Embodiment 501 also includes a head support 505 that is attached to the back support 103 via the slot 303. The rest 105 includes a brace 507 with a seat 509 attached at one end.

Figure 6:
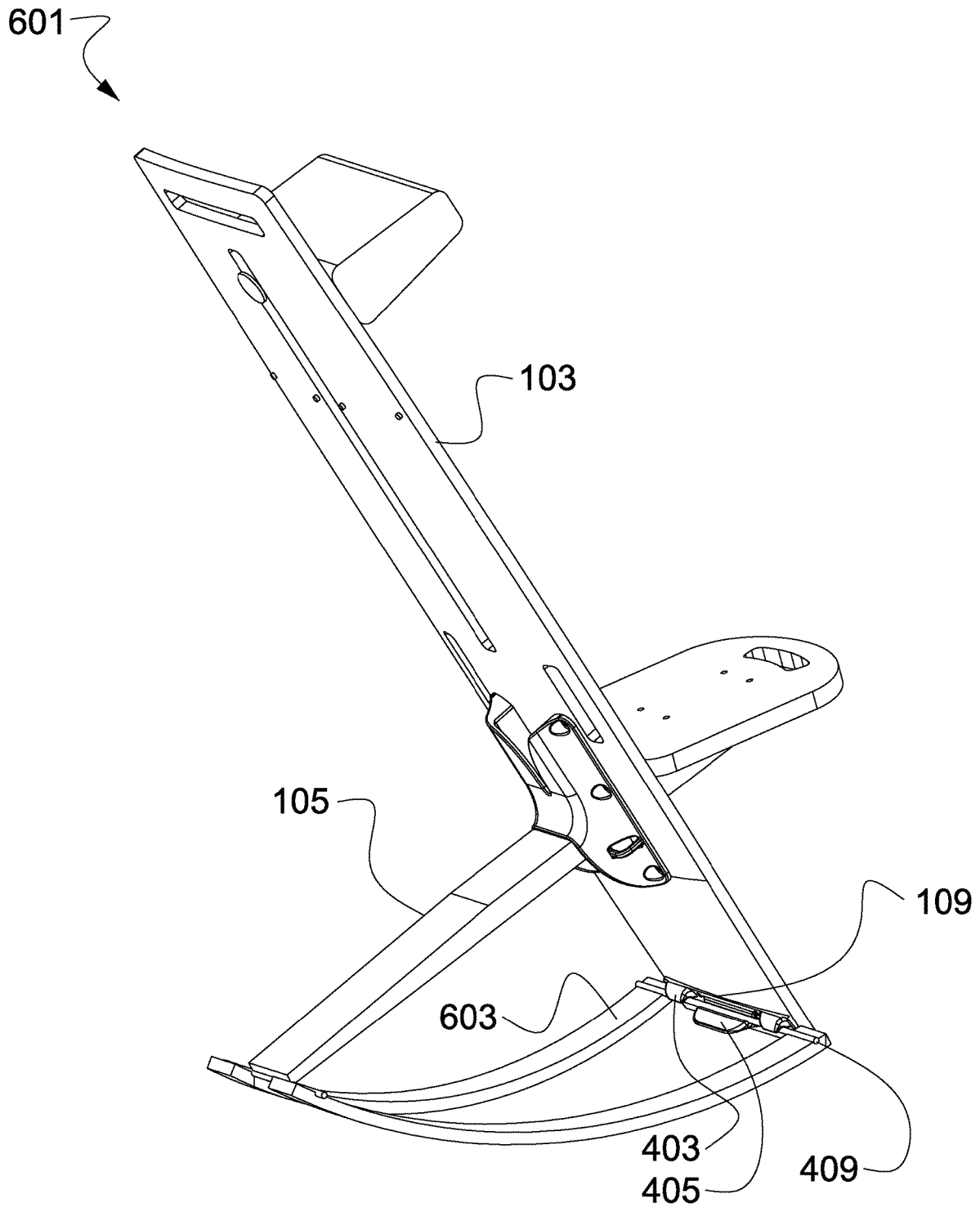
FIG. 6 is a rear perspective view of an alternate embodiment of the system of FIG. 1.

The shaft 409 could also have rockers 603 attached thereto at either end and then to the rest 105 as depicted in embodiment 601 by FIG. 6.

Figure 7A:
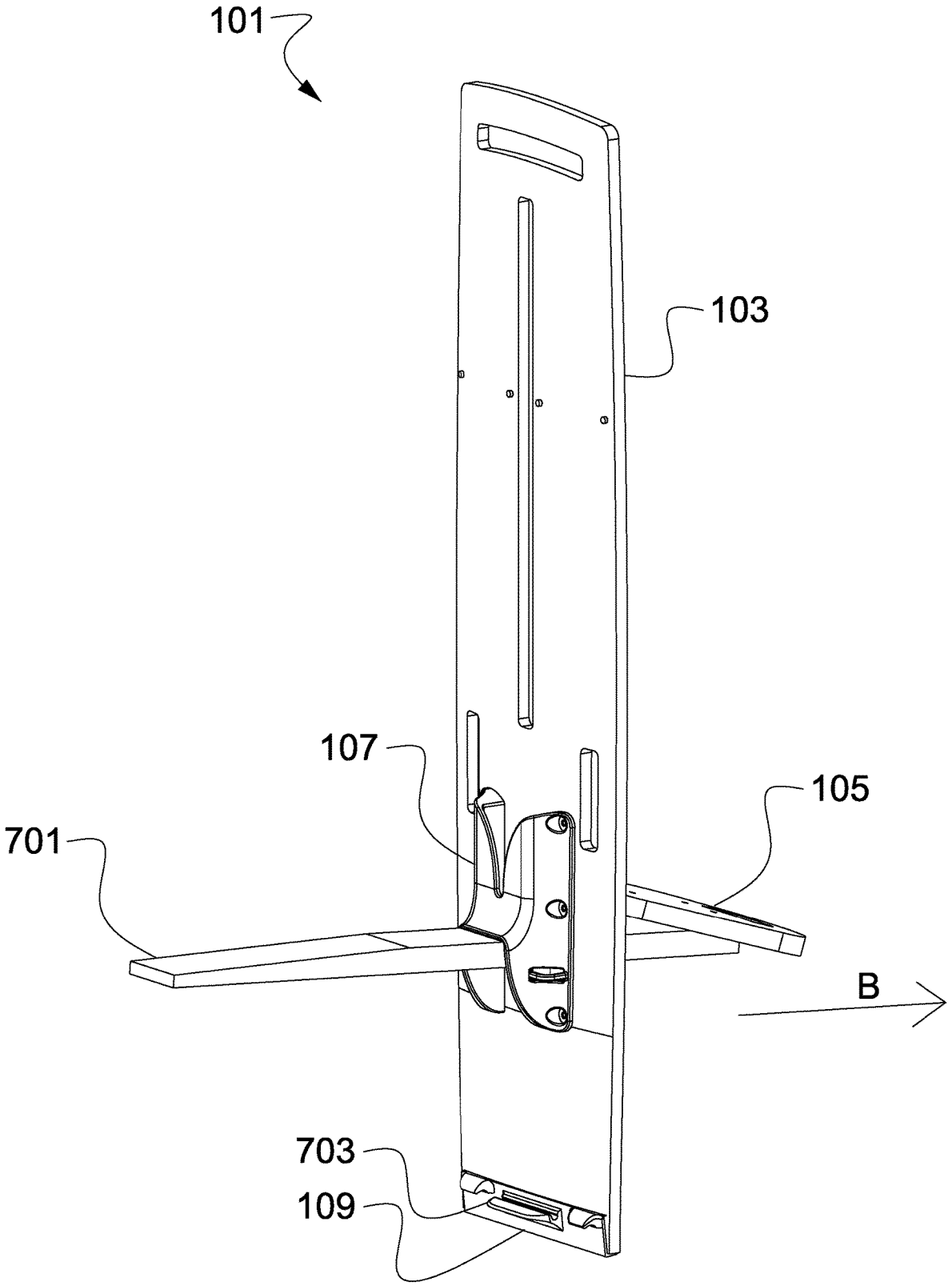
FIGS. 7A, 7B and 7C are rear perspective views of the system of FIG. 1 in use.
Figure 7B:
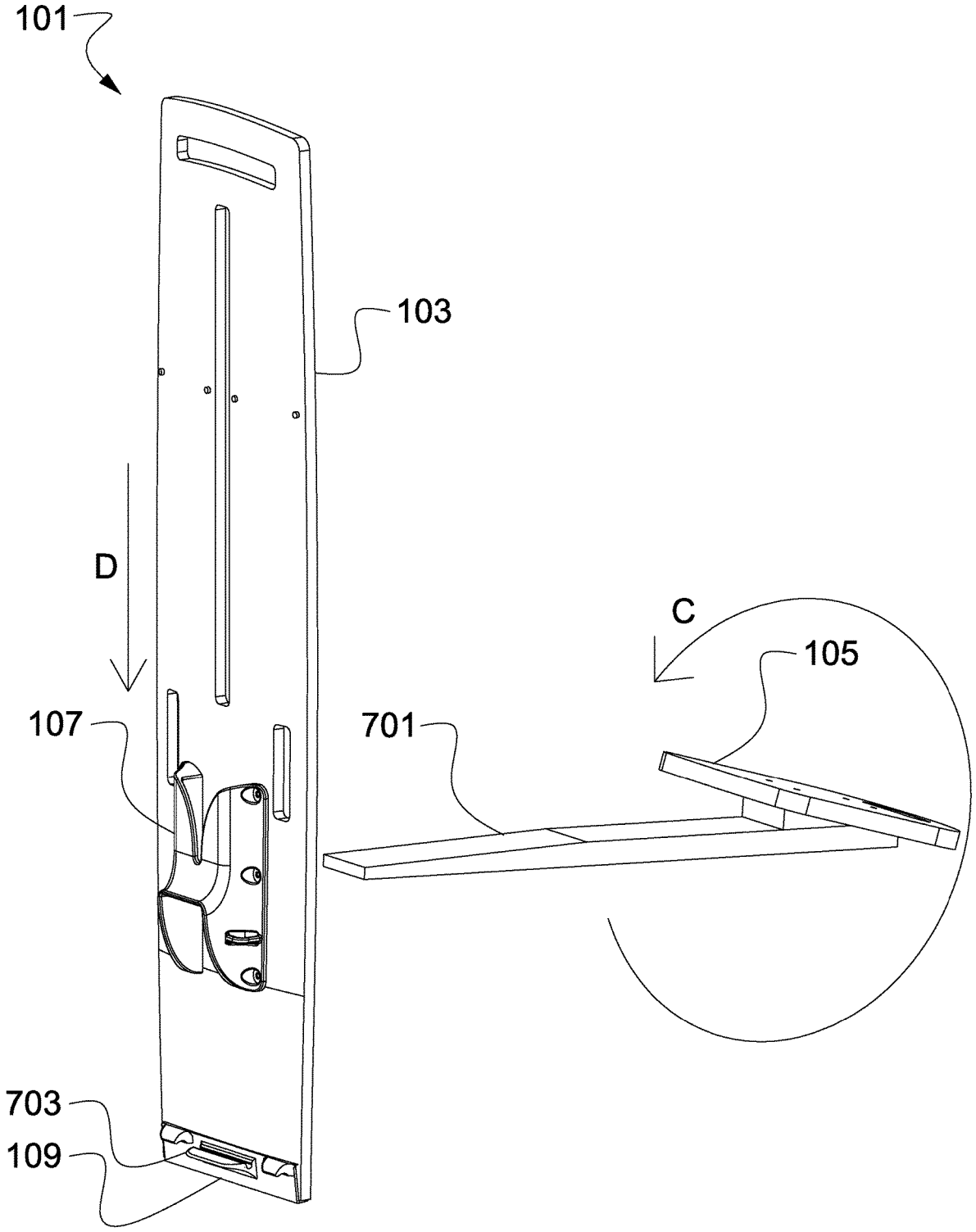
Figure 7C:
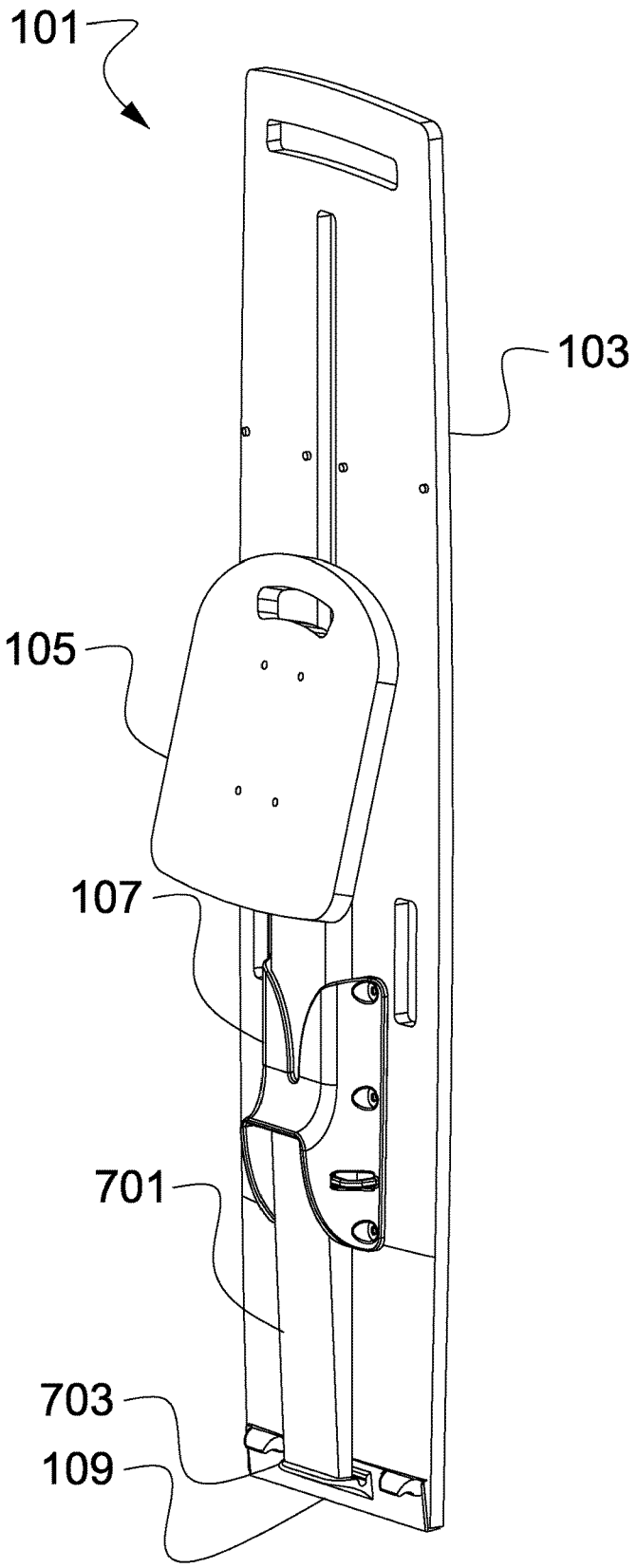

The preferred embodiment is contemplated to disassemble and stow as depicted by FIGS. 7A, 7B, and 7C. The rest 105 is removed from the back support 103 and attachment 107 as depicted by motion B, the rest 105 is then rotated as depicted by motion C and positioned behind the back support 103. The rest 105 is then placed in the channel of the attachment 107 as depicted by motion D until the leg end 701 of the rest contacts the top 703 of the guard 109. The system 101 thus stowed is carried or otherwise transported. The system 101 is assembled in the reverse process.

In use, the rest 105 is placed through the back support 103 and the opening 205 of the attachment 107. A head support 505, if used is attached to the back support 103 via the slot 303 therein. The back support 103 is placed on the ground or another surface so that the guard 109 and end 115 of the rest 105 contact the ground. A person then sits on rest 105 so that their back is against the back support 103.

Figure 8A:
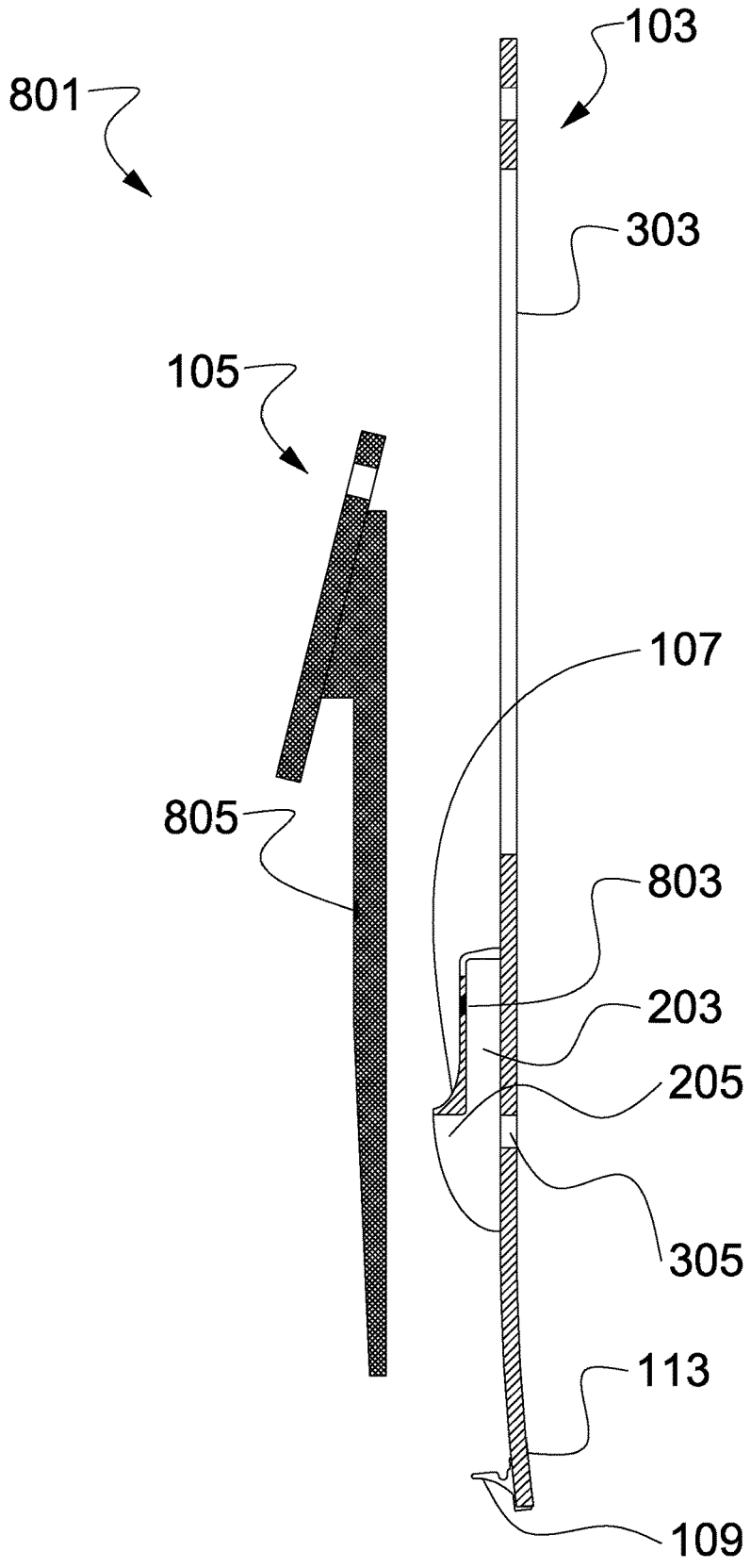
FIGS. 8A and 8B are cross-sectional side views of the system of FIG. 1 exploded and stored respectively.
Figure 8B:
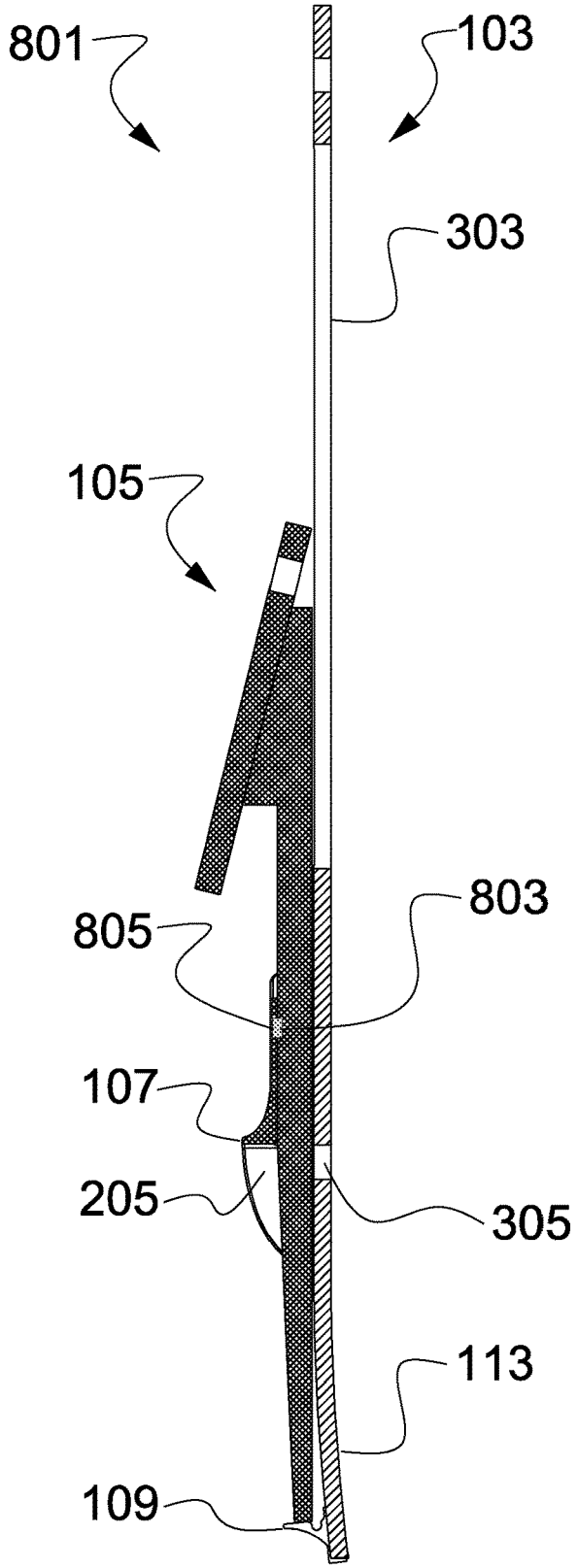

Referring now to FIGS. 8A and 8B an alternative embodiment of system 101 is depicted. Embodiment 801 includes similar features to system 101 and further includes a first magnet 803 that is attached to and embedded within the attachment 107 and corresponds to a second magnet 805 or magnetically interactive zone attached to and embedded within the rest 105. When the rest is stowed in the attachment 107 the first magnet 803 and second magnet 805 attach to each other to hold the rest 105 within the attachment 107 until the interaction is broken.

Figure 9:
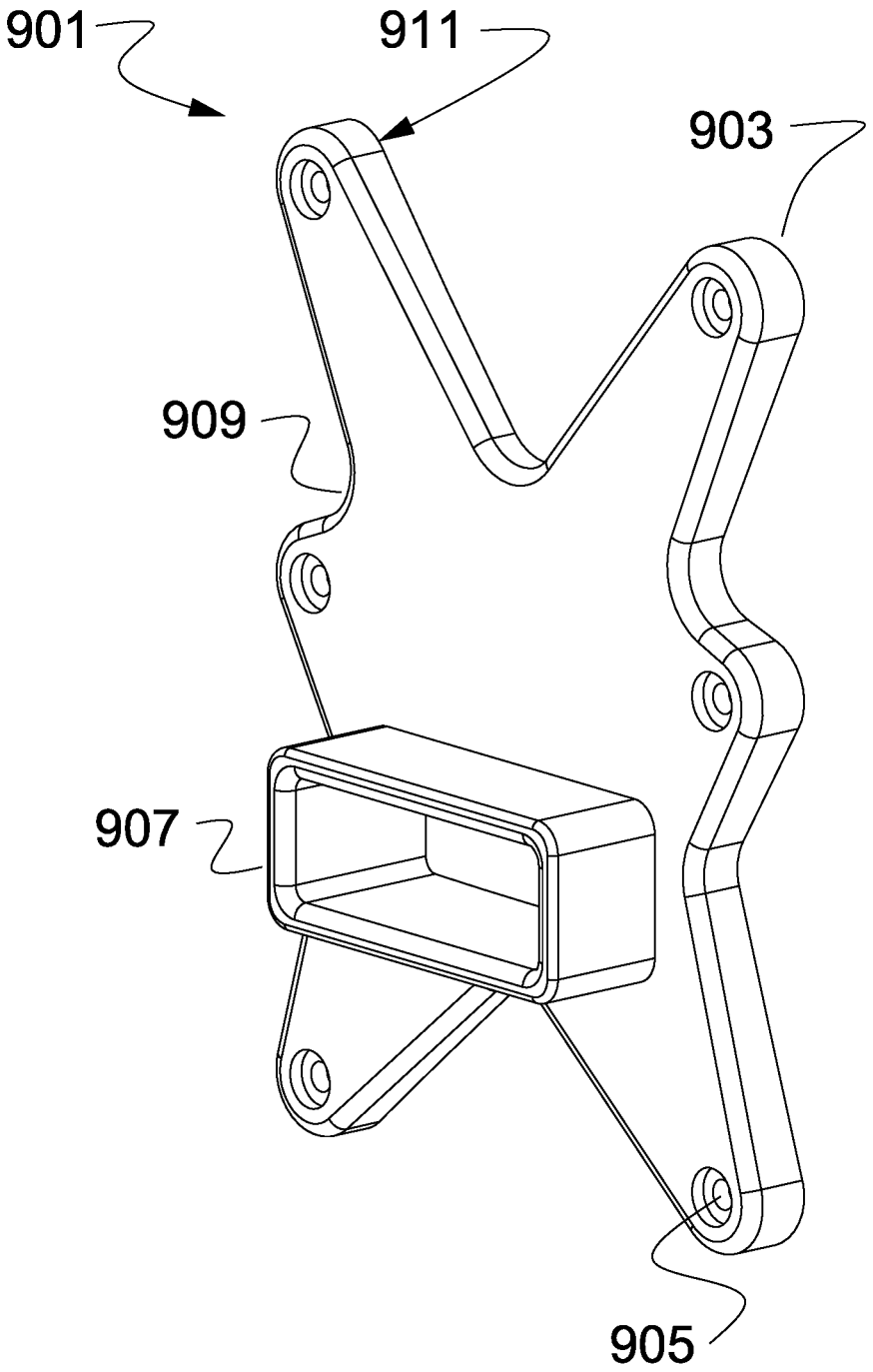
FIG. 9 is a rear perspective view of an alternative embodiment to the attachment of FIG. 2.

The attachment 107 could have various embodiments such as is FIG. 9 where embodiment 901 is depicted. Embodiment 901 includes a body 903 that includes fastener locations 905 that pass therethrough and enable attachment 901 to join with the back support 103. The body 903 includes an opening 907 that extends therethrough and has a support arm 909 that extends from it to the top edge 911. This embodiment removes the bridge but still provides the support to the system 101 through the support arm 909.

It should be appreciated that one of the unique features believed characteristic of the present application is that attachment 107 enables the back support 103 to bear the weight of a person while they sit on rest 105 repeatedly. The legs 211 disperse the forces exerted on the attachment 107 while in use over a larger area of the back support 103.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed:

1. A portable supportive seating system comprising:

at least one back support;

each of the at least one back supports includes a support body with at least one hole passing therethrough;

at least one attachment extending from the rear surface of the at least one back supports; and each of the attachments includes a body with a channel between at least two legs;

at least one opening;

at least one rest;

each of the at least one rests include a brace with a seat attached at one end;

wherein the at least one rests are placed through the at least one back supports and at least one attachments; and wherein the at least one rests are stowed between the at least one back supports and at least one attachments.

2. The system of claim 1 wherein the at least one attachment and at least one rest have a first magnet and second magnet, respectively embedded therein.

3. The system of claim 1 wherein the at least one back supports have at least one fasteners attached to the back surface thereof.

* * * * *